US009146085B1

(12) United States Patent
Braun et al.

(10) Patent No.: US 9,146,085 B1
(45) Date of Patent: Sep. 29, 2015

(54) BOWFISHING ARROWHEAD WITH IMPROVED BARB RELEASE

(71) Applicant: AMS Bowfishing, LLC., Stratford, WI (US)

(72) Inventors: Jeff Braun, Stratford, WI (US); Tim Morines, Colby, WI (US)

(73) Assignee: AMS, LLC., Stratford, WI (US)

( * ) Notice: Subject to any disclaimer, the term of this patent is extended or adjusted under 35 U.S.C. 154(b) by 0 days.

(21) Appl. No.: 14/457,677

(22) Filed: Aug. 12, 2014

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 3,014,305 | A | * | 12/1961 | Yurchich | 43/6 |
| 3,036,395 | A | * | 5/1962 | Nelson | 43/6 |
| 3,164,385 | A | * | 1/1965 | Shure | 473/582 |
| 4,742,637 | A | * | 5/1988 | Musacchia | 43/6 |
| 4,807,382 | A | * | 2/1989 | Albrecht | 43/6 |
| 4,819,360 | A | | 4/1989 | Thomas | |
| 4,901,467 | A | * | 2/1990 | Stolpe | 43/6 |
| 7,311,621 | B2 | | 12/2007 | Sullivan et al. | |
| 7,571,564 | B2 | * | 8/2009 | Sullivan | 43/6 |

* cited by examiner

*Primary Examiner* — John Ricci
(74) *Attorney, Agent, or Firm* — Boyle Fredrickson, S.C.

(57) ABSTRACT

An arrowhead for bowfishing supports pivoting barbs that may refracted rearward to pass through a fish and then extended to retain the fish on the arrow. The barbs provide a truncated stop surface striking a rear of the arrow tip when the arrow tip is tightened on the arrowhead to prevent their forward motion from the extended position when the tip is tightened on the arrowhead and yet to allow such motion when the tip is slightly loosened but not removed. The barbs are offset with respect to their pivot point so that a slight loosening of the arrow tip also allows the barbs to pass forward over the arrow tip for retraction of the fish from the arrow while the tip is retained on the arrowhead.

15 Claims, 4 Drawing Sheets

BOWFISHING ARROWHEAD WITH IMPROVED BARB RELEASE

BACKGROUND OF THE INVENTION

The present invention relates to arrowheads for hunting and the like and in particular to an improved arrowhead with retractable barbs useful for bowfishing.

Arrowheads for bowfishing may have radially extending barbs that swing rearward as the arrowhead passes through the fish, but then open to prevent the fish from slipping off of the arrow when the arrow is retrieved. In order to remove the fish from the arrow after the arrow is retrieved, the barbs may be folded forward over the arrow tip so that the arrow may be pulled backward through the fish. This forward folding of the barbs normally requires releasing a mechanical stop.

A first type of mechanical stop is released by, loosening the arrow shaft with respect to the arrowhead holding the barbs, for example, by relative rotation of a threaded coupling between the two. Separation of these components may withdraw a stop surface on the front of the arrow shaft from a stop on the barbs that normally operates to limit rotation of the barbs forward. An example of this type of stop system is shown in U.S. Pat. No. 4,819,360.

In a second type of mechanical stop, a threaded connection between the arrow head holding the barbs and the sharpened arrow tip is employed. This type of stop allows the arrowhead to be permanently attached to the arrow shaft. In this stop system, the rear of the arrow tip provides a stop surface that blocks forward rotation of the barbs. Removal of the tip allows the barbs to swing forward to extract the arrow from the fish. An example of this type of stop system is shown in U.S. Pat. No. 7,311,621.

In this latter design, the arrow tip, after being removed from the arrow, is subject to being dropped or misplaced as the fish is removed.

SUMMARY OF THE INVENTION

The present invention provides a barb design for a bowfishing arrowhead that allows the barbs to rotate forward to be extracted from the fish with only a minor loosening of the tip. In this way, the tip is always retained in connection with the arrowhead minimizing risk of loss of the tip during this process of removing the fish. The invention provides a shortened stop surface on the barb that allows the barb to rotate with only minor displacement of the tip together with an offset to the barb arm allowing the barb to swing around the diameter of the tip without interference from the tip when the tip is in place.

Specifically then the present invention provides an arrowhead with an arrowhead body extending along an arrow axis between a first and second end. The first end of the arrowhead body may attach to an arrow shaft that may extend rearwardly from the arrowhead body along the arrow axis and a second end may provide a threaded coupling extending along the arrow axis to receive an arrow tip. The arrow tip may be threaded onto the arrowhead body to be movable by rotation between a tightened and loosened position (both as attached to the arrowhead body), the loosened position displaced forwardly with respect to the tightened position. The arrowhead includes at least one arrow barb attached to the arrowhead body to pivot about a pivot axis perpendicular to the arrow axis. The barb may swing between a retracted rearward position extending rearwardly from the pivot axis along the arrow axis, through an extended position extending from pivot point in a direction perpendicular with respect to the arrow axis, and a retracted forward position extending forwardly from the pivot axis along the arrow axis.

The arrow barb may include an eye portion attached to an arm portion, the eye portion having a hole about which the arm portion pivots and the arm portion may extend from the eye portion at an offset from a line of radius of a center of the hole so that the arm portion is removed from interference with a rear edge of the arrow tip when the arm portion is in the retracted forward position and the arrow tip is in the loosened position.

It is thus a feature of at least one embodiment of the invention to allow removal of the fish from the arrow by moving the barbs to the forward retracted position without completely separating the tip from the arrowhead where it can be dropped or lost.

The offset may displace a front edge of the arm portion from the center of the hole by a distance at least equal to a radial distance between the rear edge of the arrow tip and the center of the hole measured perpendicular to the arrow axis.

It is thus a feature of at least one embodiment of the invention to allow the barbs to rest against the outer surface of the tip when the tip is loosened.

The eye may further include a stop surface abutting a rear end of the arrow tip when the barb is in the extended position and the arrow tip is in the tightened position to restrain pivoting of the barb from the extended position to the forwardly retracted position and removed from abutment with a rear end of the arrow tip when the barb pivots between the extended position and the forward retracted position and the arrow tip is in the loosened position.

It is thus a feature of at least one embodiment of the invention to prevent forward retraction of the barbs when the arrow and fish are being retrieved.

The stop surface may extend radially in a direction perpendicular to the arrow axis when abutting a rear end of the arrow tip by a distance less than a displacement of the rear edge of the arrow tip between the tightened and loosened positions.

It is thus a feature of at least one embodiment of the invention to permit disengagement of the stop surface without removal of the tip.

The loosened position may be displaced along the arrow axis by a distance substantially equal to a radial distance between the rear edge of the arrow tip and the center of the hole measured perpendicular to the arrow axis.

It is thus a feature of at least one embodiment of the invention to practically reduce the necessary loosening of the tip while providing a robust stop mechanism.

The arrow tip may provide a substantially cylindrical rear end and the rear edge of the arrow tip may be an edge defining the interface between a cylinder base defined by the rear end and a cylinder wall defined by surfaces of the arrow tip extending along the arrow axis.

It is thus a feature of at least one embodiment of the invention to provide a system that works with standard arrow tips.

These particular objects and advantages may apply to only some embodiments falling within the claims and thus do not define the scope of the invention.

DETAILED DESCRIPTION OF THE PREFERRED EMBODIMENT

Prior Art

Figure 1:
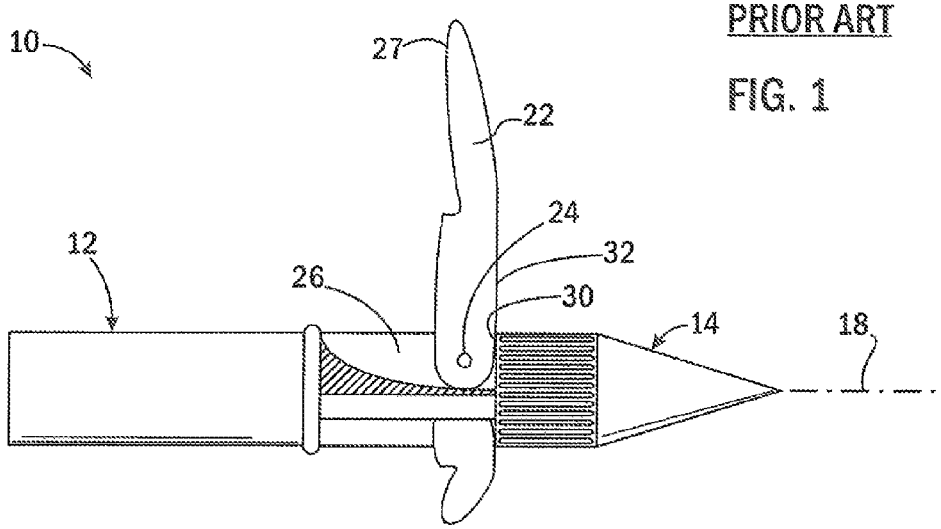
PRIOR ART FIG. 1
FIG. 1 is a side elevational view in partial cross-section of an arrowhead and arrow tip of the prior art showing a stop surface provided by the rear face of the arrow tip against the leading edge of the barb when the tip is fully tightened onto the arrowhead.
Figure 2:
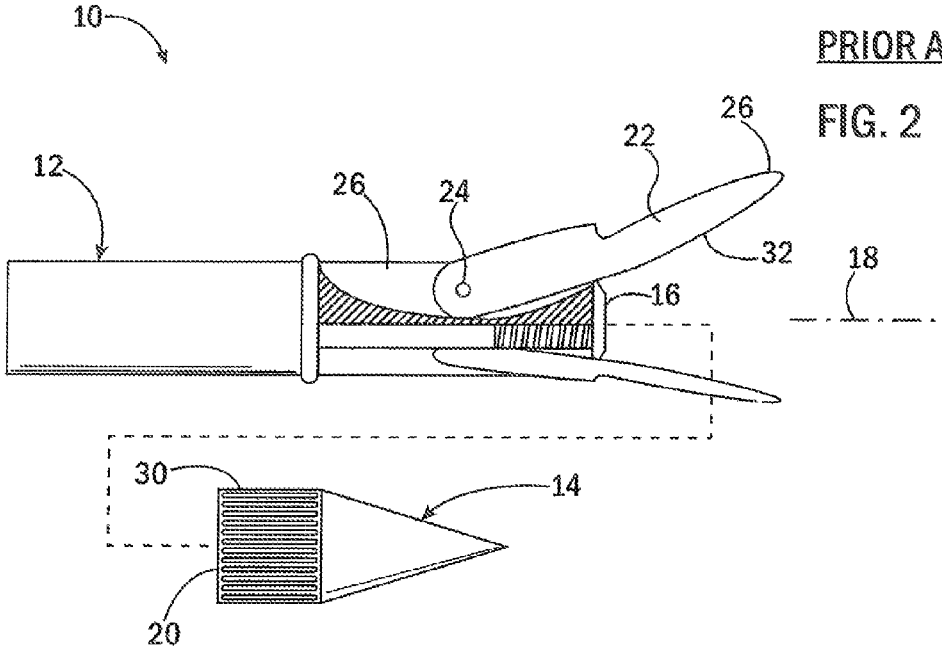
PRIOR ART FIG. 2
FIG. 2 is a figure similar to that of FIG. 1 showing the arrow tip removed such as allows the barb to swing forward without interference.

Referring now to FIGS. 1 and 2, a prior art arrowhead 10 may provide for an arrowhead body 12 that can attach to an arrow tip 14 by means of the threaded boss 16. The threaded boss 16 may project along an arrow axis 18 from the front end of the arrowhead body 12 and be received by a threaded bore 20 opening axially into a rear end of the arrow tip 14.

One or more slots 26 extending along the axis 18 may be cut radially into a front end of the arrowhead body 12 each to receive proximal ends of barbs 22. Within the slots 26, the barbs 22 are held by roll pins 24 passing through holes in the proximal ends of the barbs 22.

The barbs 22 may pivot about roll pins 24 so as to extend in a direction generally perpendicular to the axis 18 (an extended position) shown in FIG. 1 where a distal tip 27 of the barb 22 is distant from the arrowhead body 12. This position may be reached from a rearward retracted position (not shown) where a distal tip 27 of the barb 22 lies adjacent to the outer surface of the rear end of the arrowhead body 12. Forward pivoting of the barbs 22 from the position shown in FIG. 1, with a distal tip 27 extending forward, is prevented by interference between a rear edge 30 of the arrow tip 14 and a stop surface 32 being a front edge of the barb 22.

As shown in FIG. 2, with full removal of the tip 14, barb 22 may swing forward within an exposed extension of the slot 26 passing into the threaded boss 16 until stopped by interference between the stop surface 32 and a rising wall of the slot 26. This forward retracted position allows removal of the fish from the arrow.

The Present invention

Figure 3:
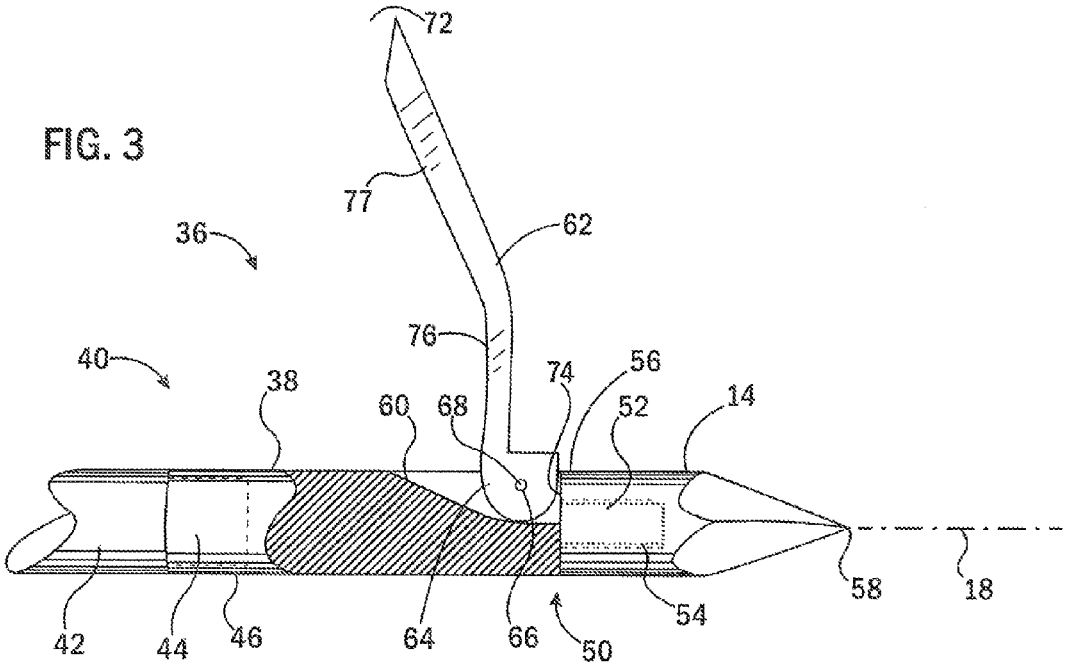
FIG. 3 is a figure similar to that of FIG. 1 showing the present invention with the tip in the tightened position such as limits forward rotation of the barb in an extended position.

Referring now to FIG. 3, the present invention provides an arrowhead 36 providing an arrowhead body 38 having a rear end 40 that may be attached to an arrow shaft 42, for example, by means of the cylindrical tendon 44 extending forward from the arrow shaft 42 received by a corresponding cylindrical bore 46 opening axially at a rear end 40 of the arrowhead body 38. The arrowhead body 38 may be constructed of a metal material such as stainless steel to be resistant from the corrosive effects of water, and in one embodiment may be substantially cylindrical. A suitable material for an arrow shaft 42 may be a composite plastic such as a pultruded fiberglass or other composite material of a type known in the art.

An arrow tip 14 may attach at a front end 50 of the arrowhead body 38, for example, by threading onto a threaded stud 52 extending forward from the arrowhead body 38. This threaded stud 52 may be received by a corresponding threaded bore 54 opening axially at the rear of the tip 14. A rear end of the tip 14 may be generally cylindrical and have the same outer diameter as the arrowhead body 38 and may present a rear circular base through which the threaded bore 54 is formed. A rear edge 56 of the tip 14 is defined by an interface between at an outer periphery of the rear circular base of the tip and a cylindrical outer periphery of the rear end of the tip 14.

The tip 14 may be in a tightened position, as shown in FIG. 3, with a rear end (base) of the tip 14 abutting a front end of the arrowhead body 38, the latter which may present a corresponding circular base from which the threaded stud 52 extends. This tightened position may be obtained by rotating the tip 14 clockwise about the axis 18 to tighten the threaded bore 54 about the stud 52.

Figure 5:
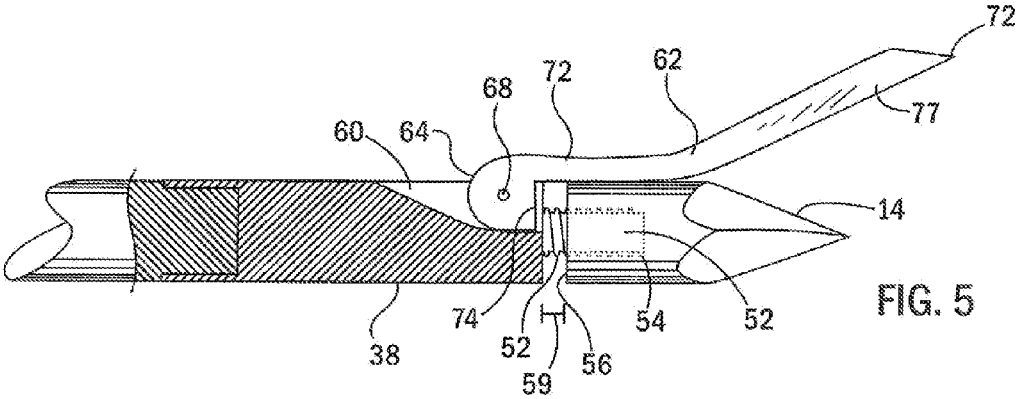
FIG. 5 is a figure similar to FIG. 3 with the tip in a loosened position but still retained on the arrowhead showing the ability of the barbs to rotate to a forward retracted position.

Alternatively, as shown in FIG. 5, the tip 14 can be loosened slightly to be displaced away from a front end of the arrowhead body 38 by displacement distance 59 in a loosened position. This loosened position may be obtained by rotating the tip 14 in a counterclockwise direction about the axis 18 to loosen the threaded bore 54 about the stud 52 and to separate the basis of the arrowhead body 38 and the tip 14.

The front end of the tip 14 may be sharpened to taper to a penetrating point 58 generally aligned with the arrow axis 18. The tip may be constructed of a machined stainless steel material.

Figure 7:
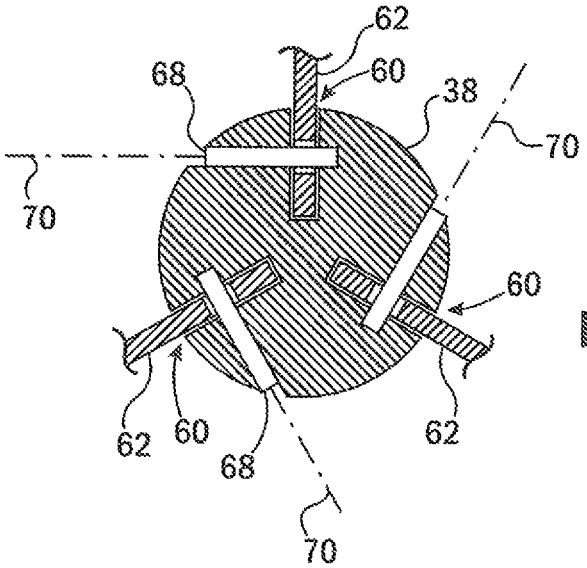
FIG. 7 is a cross-sectional view along line 7-7 of FIG. 4.

Referring now to FIGS. 3 and 7, an outer periphery of the arrowhead body 38 may provide for one or more axial slots 60 radially cut into the arrowhead body 38. One or more barbs 62 may be attached to the arrowhead body 12 by means of an eye portion 64 at a proximal end of the barb 62 having a hole 66. A hole 66 of each barb 62 may be held in a slot 60 by a roll pin 68 passing through the holes 66 and extending along different axes 70 angularly equally spaced around the arrow axis 18 and perpendicular to the arrow axis 18. The roll pins 68 may be retained by blind bores cut into the arrowhead body 38.

During use of the arrowhead 36, the eye portion 64 of a barb 62 may rotate about the roll pin 68 so that a distal end 72 of the barb 62 may fully extend along a perpendicular to arrow axis 18 to an extended position that operates to retain a fish on the arrow shaft 42 or rear end of arrowhead body 38. When the tip 14 is in the tightened position shown in FIG. 3, a stop surface 74 extending upward from the eye portion 64 abuts the rear edge 56 of the tip 14 preventing further forward movement of the distal end 72.

Figure 4:
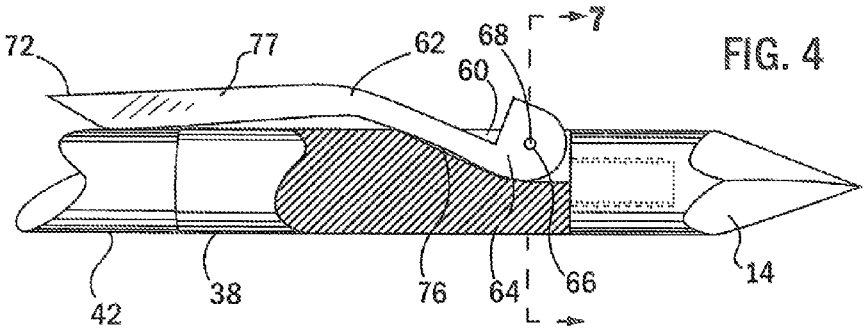
FIG. 4 is a figure similar to that of FIG. 3 showing rearward retraction of the barb with the tip in the tightened position when the arrow is in forward flight.

Referring now to FIG. 4, although forward motion of the distal end 72 is blocked when the tip 14 is in the tightened position, the barb 62 may rotate rearward so that the distal end 72 moves close to the periphery of the arrow shaft 42 or rear end of the arrowhead body 38 in a rearward retracted position that allows the arrowhead body 38 and barb 62 to pass with low resistance through the fish. In this configuration a proximal arm portion 76 of the barb 62 may lie partially within the slot 60 rearward of the eye portion 64 and be slightly angled with respect to arrow axis 18, and a distal arm portion 77 may lie more closely parallel to the arrow axis 18 against the outer surface of the arrow shaft 42 or rear end of the arrowhead body 38.

Referring now to FIG. 5, when the tip 14 is in the loosened position displaced by distance 59 forward from the arrowhead body 38 on the stud 52, the barb 62 may rotate to move the distal end 72 to a forward retracted position that allows removal of the fish in a forward direction over the barbs 62. In this position, a front edge of the proximal arm portion 76 may lie against an outer periphery of a rear end of the tip 14 and the stop surface 74 may be removed from interference with the rear edge 56 so as to allow pivoting of the eye portion 64 forward from the extended position shown in FIG. 3 to a forward retracted position shown in FIG. 5.

Generally once the tip 14 has been loosened by at least the displacement distance 59, it may continue to be loosened over an additional distance without further forward movement of the barbs 62 which are restrained only by contact between the arm portion 76 and the outer periphery of the tip 14. Some additional forward movement of the barbs 62 may be possible when the tip 14 is fully removed; however, this removal of the tip 14 is not necessary for extraction of the fish over the barbs 62 which are substantially fully in the forward retracted position when the tip 14 is in the loosened position.

Figure 6:
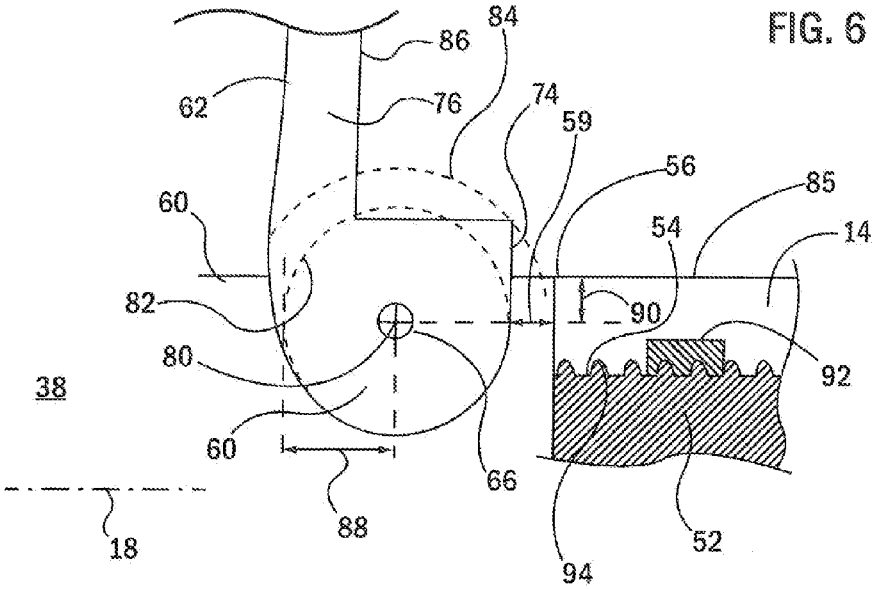
FIG. 6 is a fragmentary side elevational view of a simplified version of the barb and arrow tip showing dimensions allowing operation of the bath.

Referring now to FIG. 6, generally the periphery of the eye portion 64 will, over a portion, follow a constant radius 80 about a center 82 of the hole 66 so as to avoid interference in rotation from a bottom of the slot 60 with rotation of the barb 62 from the rearward retracted position of FIG. 4 through the forward retracted position of FIG. 5.

When the barb 62 is in the extended position, a stop surface 74 may project upward along a tangent of the constant radius 80 from the periphery of the eye portion 64 by a distance no greater than the displacement distance 59. When the tip 14 is in the tightened position, the stop surface 74 may be parallel to and abutting a rear face of the tip 14. In particular, the furthest upward extent of the stop surface 74 may contact the edge 56 to best resist rotation of the barb 62. When the tip 14 is in the loosened position, stop surface 74 may rotate within a second radius 84 to remain clear from a rear surface of the tip 14 and the rear edge 56, both being displaced from the first radius 80 by less than the distance 59.

A front edge 86 of the proximal arm portion 76 extends in offset with respect to the eye portion 64, for example, to extend upward from the eye portion 64 when the barb 62 is in the extended position of FIG. 3, along a line displaced rearward along axis 18 from the center 82 of the hole 66 by an offset distance 88. The offset distance 88 is greater in amount than a tip height 90 being measured perpendicular to the axis 18 from a center of the hole 66 to an outer peripheral edge of the tip 14. In this way, the barb 62 when moved to the forward retracted position shown in FIG. 5 may be free from interference with the rear edge 56 of the tip 14 once the tip 14 is displaced by the displacement distance 59. Front edge 86 may then provide the only contact between the barb 62 and the tip 14 and may touch an outer periphery 85 of the tip 14 well in front of the edge 56 so as to provide a constant limitation in the forward rotation of the barb 62, even as the tip is further removed, than the displacement distance 59 to the point of removal of the tip entirely. Generally, the displacement distance 59 will be a small portion, for example, less than one quarter, of the length of the stud 52, ensuring that at the displacement distance 59 and in the loosened position, the tip 14 is still securely held on the arrowhead body 38 by the threaded stud 52.

Referring still to FIG. 6 anti-vibration features may be added to the tip 14 or to the threaded stud 52 in the form of a polymer insert 92 extending from the threads of the bore 54 to be deformed by the threads of the threaded stud 52 or by means of a slight distortion in the threads 94 of either element according to known locking techniques. Other forms of thread locking can also be employed.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An arrowhead comprising:

an arrowhead body extending along an arrow axis between a first and second end, the first end attachable to an arrow shaft that may extend rearwardly from the arrowhead body along the arrow axis and a second end providing a threaded coupling extending along the arrow axis;

an arrow tip threadably attachable to the threaded coupling of the arrowhead body to be movable by rotation between a tightened and loosened position both as attached to the arrowhead body, the loosened position displaced forwardly with respect to the tightened position; and at least one arrow barb attached to the arrowhead body to pivot about a pivot axis perpendicular to the arrow axis to swing between a retracted rearward position extending rearwardly from the pivot axis along the arrow axis, through an extended position extending from the pivot point in a direction perpendicular with respect to the arrow axis, and a retracted forward position extending forwardly from the pivot axis along the arrow axis;

wherein the arrow barb includes an eye portion attached to an arm portion, the eye portion having a hole about which the arm portion pivots; and wherein the arm portion extends from the eye portion at an offset from a line of radius of a center of the hole so that the arm portion is removed from interference with a rear edge of the arrow tip when the arm portion is in the retracted forward position and the arrow tip is in the loosened position.

2. The arrowhead of claim 1 wherein the offset displaces a front edge of the arm portion from the center of the hole by a distance at least equal to a radial distance between the rear edge of the arrow tip and the center of the hole measured perpendicular to the arrow axis.

3. The arrowhead of claim 2 wherein the eye further includes a stop surface abutting a rear end of the arrow tip when the barb is in the extended position and the arrow tip is in the tightened position to restrain pivoting of the barb from the extended position to the forward retracted position and removed from abutment with a rear end of the arrow tip when the barb pivots between the extended position and the retracted forward position and the arrow tip is in the loosened position.

4. The arrowhead of claim 3 wherein the stop surface extends radially in a direction perpendicular to the arrow axis when abutting a rear end of the arrow tip by a distance less than a displacement of the rear edge of the arrow tip between the tightened and loosened positions.

5. The arrowhead of claim 4 wherein the loosened position is displaced along the arrow axis by a distance substantially equal to a radial distance between the rear edge of the arrow tip and the center of the hole measured perpendicular to the arrow axis.

6. The arrowhead of claim 4 wherein the arrow tip provides a substantially cylindrical rear end and the rear edge of the arrow tip is an edge defining an interface between a cylinder base defined by the rear end and a cylinder wall defined by surfaces of the arrow tip extending along the arrow axis.

7. The arrowhead of claim 1 wherein the threaded coupling is a threaded stud extending forward from the arrowhead body and wherein the arrowhead tip includes an axial threaded bore.

8. The arrowhead of claim 1 wherein the arrowhead body contains a slot extending along the arrow axis and into the arrowhead body and wherein the eye is held within a slot by a pin extending through the arrowhead body and slot perpendicular to the arrow axis.

9. The arrowhead of claim 8 wherein at least part of the arm portion lies within the slot when the barb is in the rearward retracted position.

10. The arrowhead of claim 1 wherein the barb extends at a substantially constant angle from the arrow axis when in the forward retracted position as the arrow tip is moved from the tightened position beyond the loosened position up until removal of the arrow tip from the arrowhead body.

11. The arrowhead of claim 1 wherein at least one arrow barb comprises three arrow barbs circumferentially disposed about the arrowhead body and having different pivot axes separated by 180 degrees of angular spacing with respect to each other.

12. The arrowhead of claim 1 wherein the threaded coupling includes an anti-vibration element selected from the group consisting of a deformable polymer element engaging threads of the threaded coupling and interference-promoting distortion of the threads.

13. The arrowhead of claim 1 wherein the arm portion of the barb joins with a distal portion curving rearward with respect to the arm portion.

14. The arrowhead of claim 1 wherein the tip is substantially cylindrical at its rear end and the arm portion of the barb contacts an outer circumference of the tip to extend parallel to the arrow axis when the barb is in the forward retracted position.

15. An arrowhead comprising:

a body having a forward end, a mounting location, a rearward end, and a longitudinal axis extending between said forward and rearward ends;

an arrowhead tip removably mounted to said forward end of said body;

an elongated grappling means having a first end and a second end, said first end of said grappling means being pivotably mounted to said mounting location of said body about an axis of rotation such that said grappling means is pivotably movable between first, second, and third positions;

said grappling means lying substantially parallel to said longitudinal axis of said body when in said first position with said second end extending rearward of said mounting location;

said second end of said grappling means extending substantially radially outward when said grappling means is in said second position;

said grappling means lying substantially parallel to said longitudinal axis of said body when in said third position with said second end extending forward of said mounting location;

a bearing surface at said second end of said grappling means so as to be contact by a target surface to pivot said grappling means from said first position to said second position when said bearing surface confronts said target surface; and said grappling means confronting said tip when in said second position so as to prevent said grappling means from rotating to said third position when the tip is adjacent to the forward end of said body and to allow said grappling means to rotate to said third position when the tip is in a displaced position away from the forward end of the body but not removed from said body;

wherein the first end of the grappling means provides a bearing portion containing a hole about which the grappling means may pivot about the axis of rotation and wherein an arm portion of the grappling means extends from the hole along a line offset from a center of the hole allowing the grappling means to move to the third position with the arm portion free from interference with a rear edge of the arrowhead tip when the arrowhead tip is in the displaced position.

* * * * *